United States Patent [19]

Luce

[11] 4,225,901

[45] Sep. 30, 1980

[54] LAMPCHANGER FOR A LIGHT

[75] Inventor: Dan G. Luce, Houston, Tex.

[73] Assignee: Tideland Signal Corporation, Houston, Tex.

[21] Appl. No.: 929,397

[22] Filed: Jul. 31, 1978

[51] Int. Cl.[3] ..... F21V 19/04; F21V 21/00; H01H 1/60; H01R 13/62

[52] U.S. Cl. ..... 362/20; 200/11 R; 200/144 R; 200/253; 200/275; 339/75 T; 339/91 L; 362/249; 362/254; 362/226

[58] Field of Search ..... 362/20, 226, 249, 254, 362/285, 287; 9/8.3 R, 8.3 E; 200/11 R, 11 G, 11 K, 144 R, 241, 242, 252, 253, 260, 275, 276, 280, 281; 339/75 R, 75 L, 75 M, 75 J, 91 L

[56] References Cited

U.S. PATENT DOCUMENTS

| | | | |
|---|---|---|---|
| 1,276,766 | 8/1918 | Howe | 362/20 |
| 2,195,374 | 3/1940 | Wallace et al. | 362/20 X |
| 2,749,527 | 6/1956 | Gast | 339/75 T X |

*Primary Examiner*—John Gonzales
*Assistant Examiner*—Thomas H. Tarcza
*Attorney, Agent, or Firm*—Fulbright & Jaworski

[57] ABSTRACT

A lampchanger for a light, such as a navigational light, having a rotatable turret for holding a plurality of lamps, fixed power contacts for engaging and lighting the lamp positioned in the operating position, and means for rotating the turret thereby placing a new lamp into operating position when a lamp burns out. The turret includes a body and a clamp yieldably urged against the body for releasably holding and locking the lamps between the clamp and the body. Lamps may slide into a tapered slot between the body and the spring-loaded clamp and are locked into place. Tilting the lamp towards the spring-loaded clamp releases the lamp. A stop limits the movement of the clamp on removing one lamp without releasing other lamps. The turret is of metal and has cooling fins for radiating heat energy. The electrical power contacts include a flat spring contact spiraling outward from the turret axis to pierce any oxides on the lamp contacts in advance of reaching the operating position. A C-shaped insulator supports the spring contacts and compensates for dimensional changes in the insulator. The insulator includes a guide recess for receiving the spiral electrical contacts. The gap in the C-shaped insulator is positioned in advance of the lamp operating position at the location where a lamp first engages the contact.

11 Claims, 11 Drawing Figures

Fig. 1
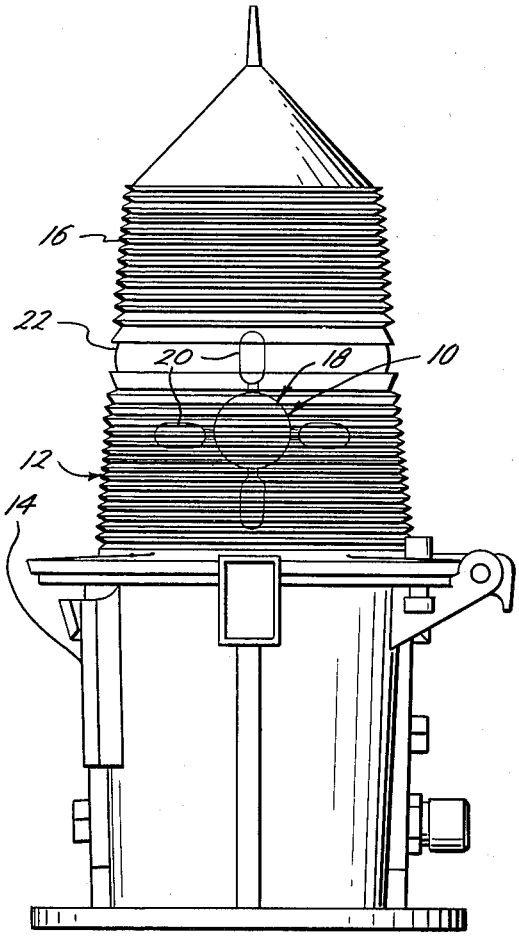
Fig. 2
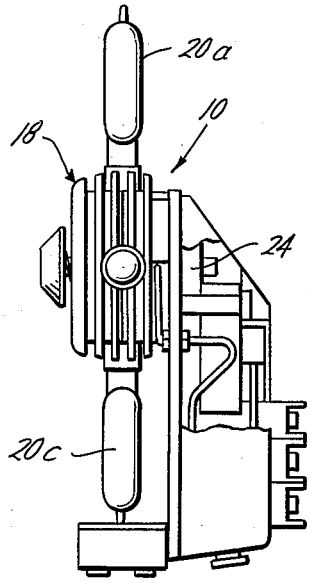
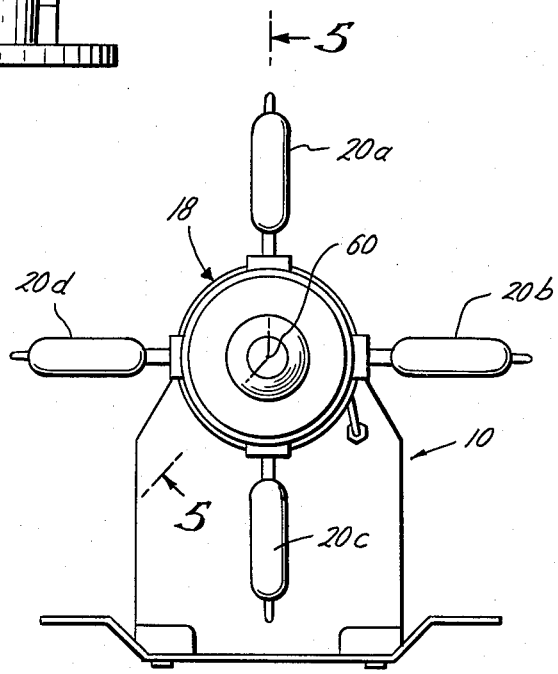
Fig. 3

LAMPCHANGER FOR A LIGHT

BACKGROUND OF THE INVENTION

Generally, it is old to provide a light, such as a navigational light with a lampchanger having a rotatable turret holding a plurality of lamps in which the turret rotates to place a new lamp in the operating position when one lamp burns out. However, such lampchangers are utilized in remote locations and must overcome severe environmental conditions, have a long life, have low maintenance and meet more stringent operating and space specifications.

The present invention is directed to various improvements in the turret, electrical contacts and supports in a lampchanger to provide a superior lampchanger.

SUMMARY

One feature of the present invention is the provision of an improved rotatable turret for holding a plurality of lamps including a turret body and a clamp coacting with the body for holding and releasably locking the lamps between the clamp and the body. Yieldable means urges the clamp and body together whereby the lamps may be inserted and removed from between the body and clamp. The body and clamp have coacting openings for securely receiving and holding the bases of the lamps and the clamp and the body each have a holding shoulder for engaging locking pins of the lamps therebetween. Preferably, the face of the clamp coacting with the body is tapered inwardly towards the body for ease in allowing the insertion of the lamp bases.

Another feature is the provision of a stop positioned adjacent the clamp limiting the movement of the clamp relative to the body for insuring that the removal of one lamp does not release other lamps from the turret.

In addition, the body and the clamp are metal and include cooling fins on their outer periphery for radiating heat from the lamps. For insulating the heat of the turret from the lampchanger, a circular insulating bushing is provided between the body and the lampchanger.

Another feature of the present invention is the improvement in power contacts for engaging and lighting the lamp positioned in the operating position. A power contact includes a spiral electrical conducting spring spiraling outwardly from the axis of the turret with the most outward extent being at the operating position. The spring may be a flat spring having a free portion with the end of the free portion located adjacent the operating position and the spiral may be in the form of an Archimedes spiral. The spring extends outwardly sufficiently to make contact with a rotating lamp in advance of the operating position to pierce through any oxides on the lamp base, but at a low angle of contact to prevent stalling of the motor rotating the turret. Preferably, the free portion of the spiral spring is approximately 180° to distribute the compression around a greater extent of the spring.

Still a further object of the present invention is the provision of a C-shaped insulator supporting the electrical contacts in which the insulator includes a guide recess for receiving the free end of the contacts when the free ends are compressed upon engagement with a lamp. The insulator may be positioned about the shaft rotating the turret and the C-shape insures that any dimensional changes of the insulator from moisture and temperature will not cause the insulator to close in and seize on the shaft. Preferably, the gap in the C-shape insulator is positioned in advance of the lamp operating position at the location where a lamp first engages the spiral contact whereby any arcing and heating occuring at the point of engagement occurs remote from the insulator and prevents degradation of the insulator by heat and arcing.

Other and further objects, features and advantages will be apparent from the following description of a presently preferred embodiment of the invention, given for the purpose of disclosure, and taken in conjunction with the accompanying drawings.

BRIEF DESCRIPTION OF THE DRAWINGS

FIG. 1 is an elevational view of the use of the present invention in a navigational light, FIG. 2 is an enlarged side elevational view of the lampchanger of the present invention, FIG. 3 is a front elevational view of the lamp-changer of the present invention.

DESCRIPTION OF THE PREFERRED EMBODIMENT

Figure 6:
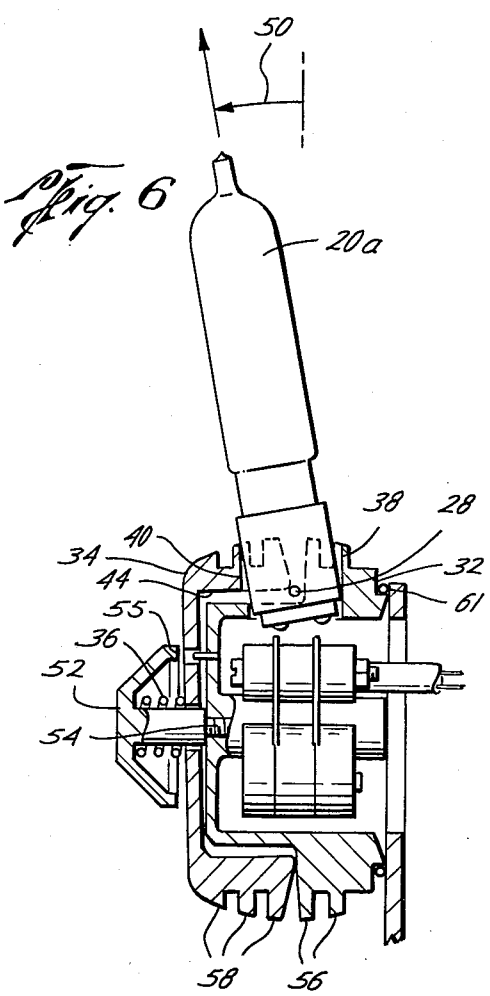
FIG. 6 is a fragmentary elevational view, in cross section, showing the removal of a lamp from the turret of the lampchanger of the present invention.

Referring now to the drawings, and particularly to FIGS. 1, 2 and 3, the reference numeral 10 generally indicates the improved lampchanger of the present invention shown in use in a navigational light, generally indicated by the reference numeral 12, having a base 14 and a lens 16. The lampchanger 10 includes a rotatable turret 18 holding a plurality of lamps 20*a*, 20*b*, 20*c* and 20*d*, in which one of the lamps such as the upper lamp 20*a* is in the operating position at the focal point 22 of the lens 16. When the lamp 20*a* in the operating position burns out the rotatable turret 18 is actuated to rotate a new lamp 20*b* into the operating position by a motor 24.

Figure 5:
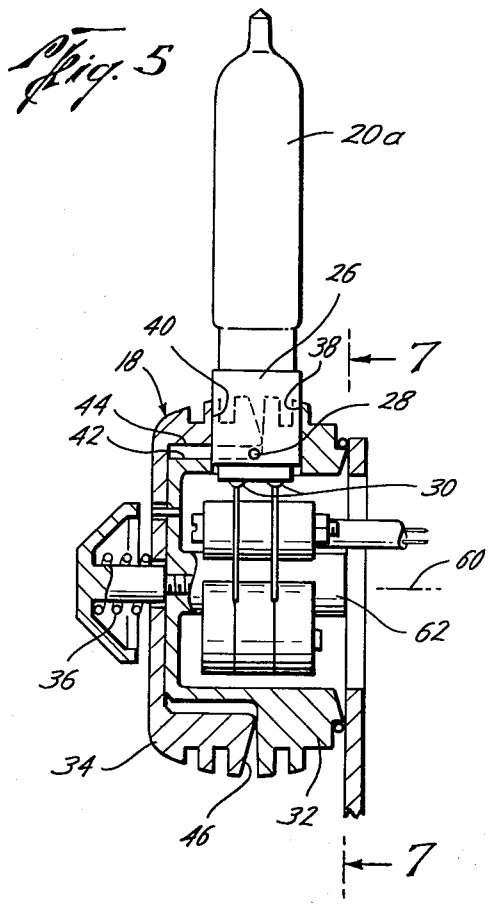
FIG. 5 is a cross-sectional view taken along the line 5—5 of FIG. 3 showing a lamp fully installed in the turret of the lampchanger of the present invention.

Referring now to FIG. 5, each of the lamps 20*a*–20*d* may include a base 26, one or more locking pins 28, such as bayonet pins, and one or more electrical contacts 30. The turret 18 generally includes a turret body 32, a clamp 34, and yieldable means such as a spring 36 urging the clamp 34 against the body 32. The body 32 and the clamp 34 include coacting openings 38 and 40, respectively, generally semi-circular for receiving the bases 26 of the lamps 20*a*–20*d*. In addition, the body 32 and the clamp 34 each include a holding shoulder 42 and 44 respectively, for engaging the locking pins 28 for securely holding the lamps in the turret 18. Preferably, a tapered slot is provided between the coacting faces of the body 32 and clamp 34 such as providing a tapered face 46 on the clamp 34 which is directed inwardly towards the body for allowing insertion of the lamps 20*a*–20*d*.

Figure 4:
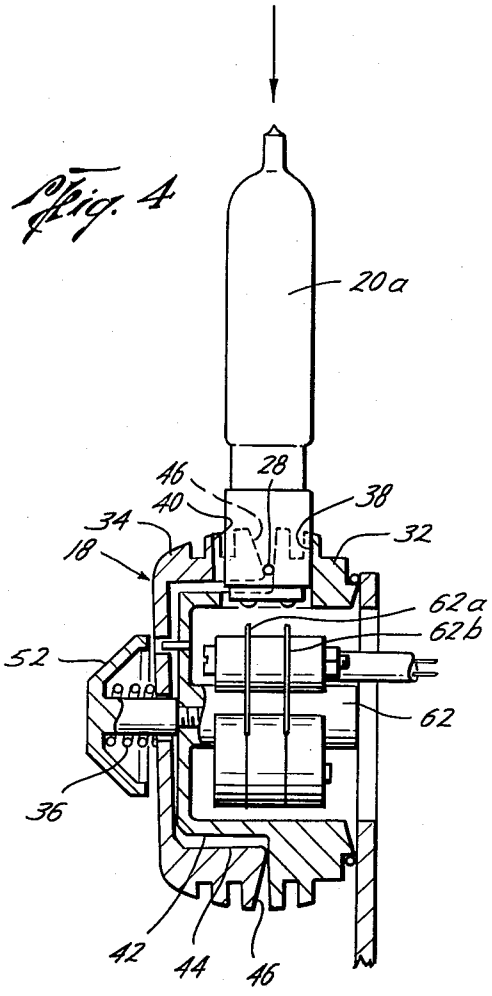
FIG. 4 is an enlarged fragmentary cross-sectional view of the lampchanger of the present invention in which a lamp is being inserted into the turret.

Referring now to FIG. 4, the installation of a lamp into the turret 18 is best seen in which the lamp 20*a* is vertically pushed into the openings 38 and 40 of the body 32 and clamp 34 and the locking pins 28 of the lamp 20*a* slide into the slot and against the tapered face 46 forcing the clamp 34 away from the body 32 until the locking pins 28 engage the shoulder 42 of the body 32 at which time the clamp 34 snaps over the top of the locking pins 28, as best seen in FIG. 5, locking the lamp 20*a* in place.

In order to remove a lamp 20*a*, as best seen in FIG. 6, a horizontal force 50 is applied against the lamp 20*a* to tilt the lamp 20*a* towards the spring-loaded clamp 34 sufficiently to expose the bayonet pins 28 and release them from the holding shoulder 44 of the clamp 34 whereby the lamp 20*a* may be vertically removed. The lamps are securely held in position, but they may be easily installed by an inward push, or removed by a tilt and outward pull even under adverse working conditions. Preferably, the spring retainer 52 is secured to the body 32 by a threaded pin 54 and includes a clamp stop 55 adjacent the clamp 34 which limits the outward movement of the clamp 34 away from the body 32 whereby in the removal of one of the lamps 20*a* the clamp 34 will move sufficiently to expose the bayonet pins 28 on the lamp 20*a* being removed without releasing the pins on the remainder of the lamps 20*b*–20*d* being held in the turret 18.

It is preferable that the lamps be tungsten halogen lamps which have the advantage of maintaining their initial light output throughout their life, are more compact, and have twice the life of a comparable wattage incandescent lamp. However, in using tungsten halogen lamps, it is important to maintain a firm mechanical and electrical contact between the turret 18 and the lamp bases 26 to prevent arcing and corrosion and also to keep the heat in the socket area below the recommended maximum. Because the radiant energy from tungsten halogen lamps is approximately 70% infra-red they create a source of concentrated radiant heat which will pass through air and glass but only a short distance through metals. Preferably, the body 32 and clamp 34 of the turret 18 is metal, such as aluminum, and the spring-loaded clamp 34 securely holds the lamps 20 by their bases 26 for maximum heat transfer and preferably the body 32 and clamp 34 are provided with cooling fins 56 and 58, respectively, for radiating heat energy away from the lamp bases 26. In addition, a suitable insulator such as a Teflon bushing 61 is provided which thermally insulates the remainder of the lampchanger 10 from the heat in turret 18.

As best seen in FIGS. 1–6, the turret 18 holds a plurality of lamps 20*a*–20*d*, here shown as four, by their bases 26 and rotates the lamps 20*a*–20*d* about the axis 60, preferably by a motor 24 (FIG. 2) actuating a shaft 62 extending coaxially through the axis 60 of the turret 18 and connected to the turret body 32. One or more fixed power contacts 62*a* and 62*b* are provided for engaging the lamp 20*a* in the operating position without engaging the remainder of the bulbs 20*c*–20*d*.

Another feature of the present invention is the provision of the fixed electrical contacts 62*a* and 62*b* in the form of a spiral electrical conducting spring, as best seen in FIGS. 7–11, which spirals uniformly outwardly from the axis 60 of the turret 18. The spiral may be an Archimedes spiral, a plane curve generated by a point moving away from a fixed point at a constant rate while the radius vector from the fixed point rotates at a constant rate. The spiral springs 62*a* and 62*b* preferably have a free portion 64 of an extent of about 180° with the free end 66 positioned adjacent the operating position. However, the free portion 64 extends outwardly sufficiently to make contact with a rotating lamp at least 20°, and preferably 45°, in advance of the lamp operating position whereby the lamp base contacts 30 make contact with the spring contacts 62*a* and 62*b* causing the spiral contact 62*a* and 62*b* to pierce through any oxides on the lamp contacts 30. That is, the lamp contacts 30 may oxidize in their sockets for a considerable period of time before being actuated into an operating condition but the contacts 30 are cleaned immediately prior to being placed into service. The spiral spring contacts 62*a* and 62*b* are compressed towards the axis 60 to obtain maximum pressure with the contacts 30 on the lamp bases 26 as the lamp reaches its vertical operating position thereby preventing arcing or pitting from occurring in the operating position. Because of the acute angle of approach of the contacts 30 towards the spring contact 62*a* and 62*b* and the narrow frontal area of the contacting edges of the contacts 62*a* and 62*b*, a line contact with substantial pressure can be obtained without reaching the stalling torque of the motor 24. The flat spiral construction of the contacts 62*a* and 62*b* stresses the springs along their greatest and strongest cross-sectional axis and distributes the stress around the 180° free portion 64 of the spiral for uniform tension, maximum strength and memory.

The fixed spiral and electrical contacts 62*a* and 62*b* are supported by a C-shaped insulator generally indicated by the reference numeral 70 which is positioned about the shaft 62 with a minimum clearance. However, dimensional changes may occur in the insulator 70 due to moisture absorption and temperature changes, but because of the gap 72 in the insulator 70, normal dimensional changes will not cause the insulator 70 to close on the shaft 70 with a resulting seizure as might be the case if the insulator 70 were a continuous circle. For ease of manufacture, the insulator 70 may be manufactured of identical components 74, 76, and 78 which have interlocking components for assuring a concentric assembly 70. Openings 80 and 82 are provided in the insulator assembly 70 for guiding and allowing the free portion 66 of the spiral springs 62*a* and 62*b* to be compressed therein upon contact with a lamp 20 thereby providing a guide and support for the free ends 66.

Figure 7:
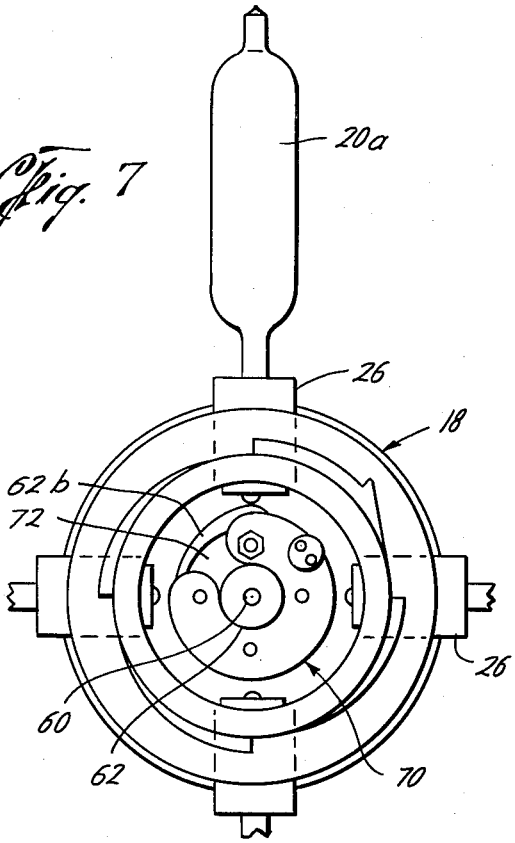
FIG. 7 is a cross-sectional view, taken along the line 7—7 of FIG. 5.
Figure 8:
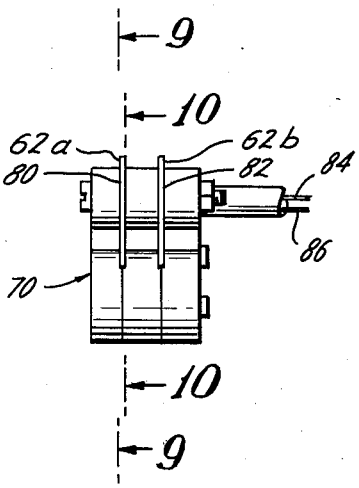
FIG. 8 is an elevational view of the electrical power contacts and support insulator of the lampchanger of the present invention.
Figure 9:
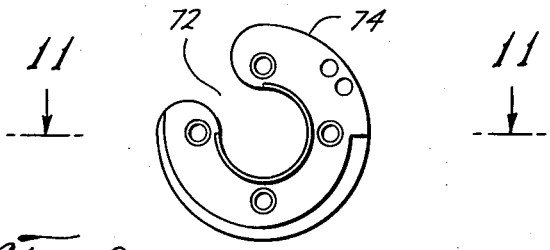
FIG. 9 is a cross-sectional view taken along the line 9—9 of FIG. 8.
Figure 10:
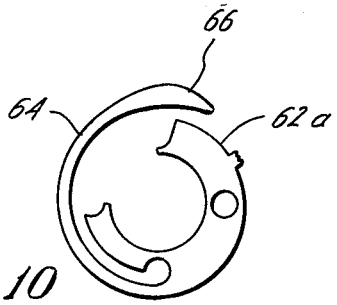
FIG. 10 is a cross-sectional view taken along the line 10—10 of FIG. 8.
Figure 11:
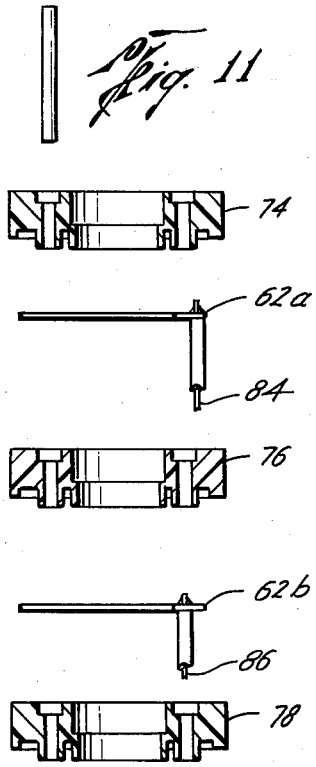
FIG. 11 is an exploded view of the power contacts and insulator taken along the line 11—11 of FIG. 9.

As previously been mentioned, the conductors 30 of the lamps 20 first contact the spiral fixed contacts 62*a* and 62*b* about 45° before the lamp reaches the operating position. Temporary electrical arcing and heat occurs at the point of initial contact and therefore as best seen in FIG. 7, the gap 72 is positioned in advance of the lamp operating position at the location where a lamp first engages the contacts 62*a* and 62*b*. Therefore, any arcing and heating occurring at the point of initial engagement of the lamps 20 with the contacts 62 and 62*b* occurs in the gap 72 thereby avoid insulator degradation. Preferably, the insulator 70 is made of an unfilled polycarbonate. Electrical connections 84 and 86 are made through the insulator assembly 70 to the fixed contacts 62*a* and 62*b*.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts will readily suggest themselves to those skilled in the art which are encompassed within the spirit of the invention and the scope of the appended claims.

What is claimed is:

1. In a lampchanger for a light having a rotatable turret for holding a plurality of lamps, fixed power contacts for engaging the lamp positioned in the operating position, and means for rotating the turret, the improvement in said turret comprising, a turret body, a clamp coacting with the body for holding and locking the lamps between the clamp and the body, yieldable means yieldably urging said clamp and body together whereby lamps may be inserted and removed from between the body and clamp, and a stop positioned adjacent the clamp limiting the movement of the clamp relative to the body for insuring that the removal of one lamp does not release other lamps from the turret.

2. In a lampchanger for a light having a rotatable turret for holding a plurality of lamps having a locking pin on the lamp bases, fixed power contacts for engaging the lamp positioned in the operating position, and means for rotating the turret, the improvement in said turret comprising, a turret body, a clamp coacting with the body for holding and locking the lamps between the clamp and the body, said body and clamp having coacting openings for receiving the bases of said lamps, said body and clamp each having a holding shoulder for engaging the locking pins of said lamps therebetween, and spring means yieldably urging said clamp and body together whereby lamps may be inserted and removed from between the body and clamp.

3. The apparatus of claim 2 wherein, the face of the clamp coacting with the body is tapered inwardly towards the body for allowing the insertion and removal of the locking pins on the lamps.

4. In a lampchanger for a light having a rotatable turret for holding a plurality of lamps and rotatable about at least one fixed power contact for engaging the lamp positioned in the operating position, and means for rotating the turret, the improvement in said power contact comprising, said contact including a flat spiral electrical conducting spring spiraling outwardly from the axis of the turret and having a free end located adjacent the operating position providing a peak at a position past the operating position to preload the lamp against rotation, the width of the spring being less than the thickness of said spring thereby providing an increased spring contact force when the spring is in contact with a lamp, a C-shaped insulator supporting said contact, said insulator including a recess for receiving and supporting the free end of the contact when the free end is compressed upon contact with a lamp wherein the gap in the C-shaped insulator is positioned in advance of the lamp operating position at the location where a lamp first engages the contact.

5. In a lampchanger for a light having a rotatable turret for holding a plurality of lamps and rotatable about at least one fixed power contact for engaging the lamp positioned in the operating position, and means for rotating the turret including a shaft extending coaxially in the turret, the improvement in said power contact comprising, said contact including a spiral electrical conducting spring spiraling outwardly from the axis of the turret and having a free end located adjacent the operating position, a C-shaped insulator about the shaft and supporting said contact, said insulator including a recess for receiving the free end of the contact when the end is compressed upon contact with a lamp, said gap in the C-shaped insulator positioned in advance of the lamp operating position at the location where a lamp first engages the contact whereby electrical arcing and heating occurring at the point of engagement is remote from the insulator.

6. A lampchanger for a light comprising, a rotatable turret for holding a plurality of lamps and including a turret body, a clamp coacting with the body for holding and locking the lamps between the clamp and the body, and spring means yieldably urging said clamp and body together whereby lamps may be inserted and removed from between the body and clamp, a fixed electrical contact within said turret including a spiral electrical conducting spring spiraling outwardly from the axis of the turret with its most outward extent toward the lamp being positioned to engage the lamp in the operating position, means for rotating the turret, a C-shaped insulator supporting said contact, said insulator including a recess for receiving and supporting the contact compressed into the recess upon contact with a lamp, and the gap in the C-shaped insulator is positioned in advance of the lamp operating position at the location where a lamp first engages the contact.

7. The apparatus of claim 6 wherein, the face of the clamp coacting with the body is tapered downwardly and inwardly for allowing the insertion of the lamps.

8. A lampchanger for a light comprising, a rotatable turret for holding a plurality of lamps which have at least one locking pin on the lamp bases, said turret including, a turret body, a clamp coacting with the body for holding and locking the lamps between clamp and the body, said body and clamp having coacting openings for receiving the bases of said lamps, said body and clamp each having a holding shoulder for engaging the locking pins of said lamps therebetween, spring means yieldably urging said clamp and body together whereby lamps may be inserted and removed from between the body and clamp, the face of the clamp coacting with the body is tapered downwardly and inwardly for allowing the insertion and removal of holding pins on the lamps, means for rotating the turret including a shaft extending coaxially in the turret, at least one fixed electrical contact within the turret for contacting a lamp in the operating position, said contact including a spiral electrical conducting spring spiraling outwardly from the axis of the turret with its most outward extent towards the lamps being positioned to engage the lamp in the operating position, said spring being a flat spring having a free portion of more than 45 degrees with the free end located adjacent the operation position, and the spring extends outwardly sufficiently to make contact with a rotating lamp in advance of the lamp operating position, a C-shaped insulator about the shaft and support said contact, said insulator including a recess for allowing the free end of the contact to be compressed into said recess upon contact with a lamp, said gap in the C-shaped insulator positioned in advance of the lamp operating position at the location where a lamp first engages the contact.

9. The apparatus of claim 8 including, a stop positioned adjacent the clamp limiting the movement of the clamp relative to the body for insuring that the removal of one lamp does not release other lamps from the turret.

10. In a lampchanger for a light having a rotatable turret for holding a plurality of lamps having a locking pin on the lamp bases, fixed power contacts for engaging the lamp position in the operating position, and means for rotating the turret, the improvement in said turret comprising, an annular vertically extending turret body connected to a rotatable horizontal shaft, an annular movable vertically extending clamp coacting with the body for holding and locking the lamps between the clamp and the body, said body and clamp having coacting openings for receiving the bases of said lamps, and spring means yieldably urging said clamp and body horizontally together whereby the lamps may be inserted and removed from between the body and clamp.

11. The apparatus of claim 10 including, the coacting face of one of the clamp and body being tapered towards the shaft for allowing the insertion and removal of the locking pins on the lamp.

* * * * *